United States Patent [19]

Winant

[11] 4,367,761

[45] Jan. 11, 1983

[54] PORTABLE FABRIC SHELTER

[76] Inventor: Daniel Winant, 144 Rue de la Source, 92000 Nanterre, France

[21] Appl. No.: 175,961

[22] Filed: Aug. 7, 1980

[30] Foreign Application Priority Data

Aug. 14, 1979 [FR] France ..... 79 20671

[51] Int. Cl.[3] ..... E04B 1/347

[52] U.S. Cl. ..... 135/87

[58] Field of Search ..... 135/1 R, 5 R

[56] References Cited

U.S. PATENT DOCUMENTS 3,374,797 3/1968 Neumark ..... 135/1 R
3,693,641 9/1972 Moss ..... 135/1 R

FOREIGN PATENT DOCUMENTS 1256396 12/1967 Fed. Rep. of Germany .
1373418 8/1964 France .
1470488 1/1967 France .
2336099 7/1977 France .

*Primary Examiner*—J. Karl Bell

[57] ABSTRACT

This shelter comprises at least one roofing formed by a plurality of fabric panels which are assembled in their upper part along curvilinear edges. The edge of each panel forms two curves which converge at a center point and all the panels are united at this center point. The lower side of each panel is provided with two cables for exerting a tension thereon. These cables are spaced apart a distance which is less than the distance between the support posts supporting the outer ends of the seams between adjacent panels. A shelter having three panels thus covers a hexagonal area on the ground and a completely free space.

16 Claims, 11 Drawing Figures

PORTABLE FABRIC SHELTER

DESCRIPTION

Shelters capable of being taken down such as roofs, tents or the like, are essentially adapted to be employed during a short period and to be subsequently taken down and transported. Consequently, one of their prime qualities is to be light and of small overall size.

An object of the present invention is to satisfy this requirement by providing a shelter whereby it is possible, with the minimum amount of material, to cover a maximum area or envelop a maximum volume.

According to the invention, there is provided a shelter which comprises panels of fabric which are interconnected in their upper part along an edge of curvilinear shape whose concavity faces outwardly and are adapted to receive support posts at the outer end points of this edge, and tensioning means extending from the lower edge of the panels at two points spaced apart a distance less than that between the points receiving the posts.

The curvilinear shape of the upper edge of the panels and the manner of putting the latter under tension enables the fabric to receive very evenly distributed tension forces and thus to protect a relatively large area on the ground. Such a shelter may form a fabric roof, a big top, or may be if desired completed by lateral walls so as to form a complete tent. It is more particularly adapted for the construction of a tent or a roof having a plurality of sides, for example for sheltering a space of hexagonal, octogonal or other shape, the number of panels being then equal to or exceeding three. Irrespective of the shape and dimensions of the constructed shelter, the latter does not have a framework but merely a small number of posts all of which are located at its periphery, so that the internal volume is fully available. On the other hand, the material employed, namely the material to be transported, is small in size.

The ensuing description of embodiments, which are given solely by way of example and shown in the accompanying drawings, will further bring out the advantages and features of the invention.

Figure 1:
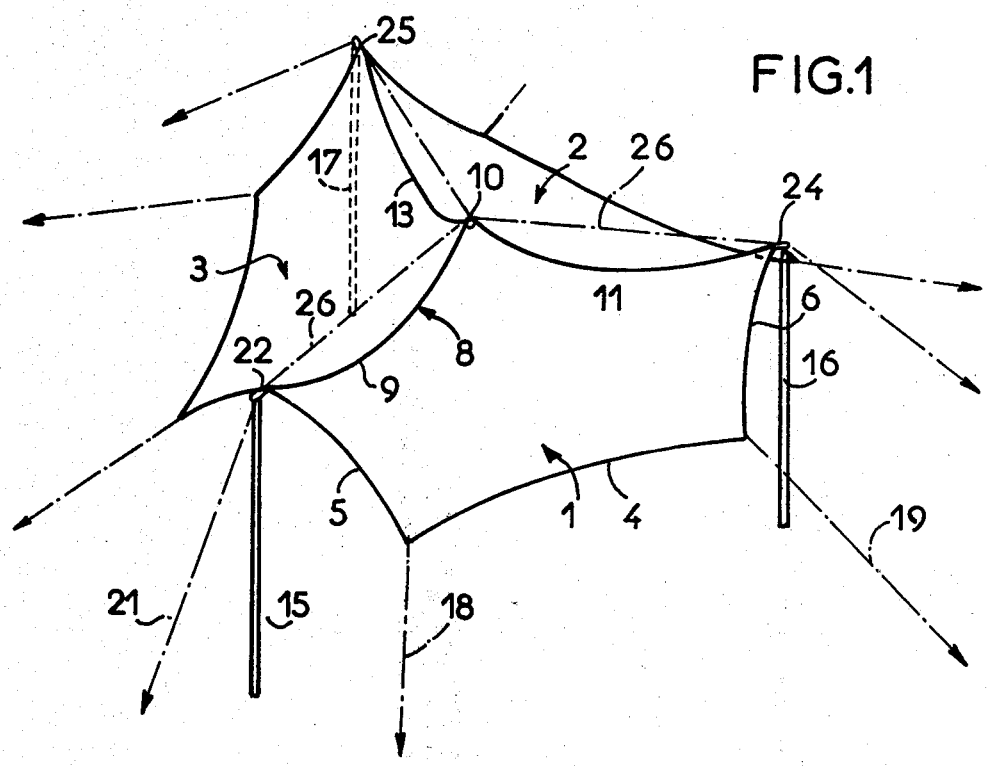
FIG. 1 is a perspective view of a shelter according to the invention.

The shelter which is capable of being taken down is constructed by means of fabric or canvas panels, namely three panels in the embodiment shown in FIG. 1. Each of these panels 1, 2 and 3 has a lower edge 4 between two lateral edges 5, 6 respectively, which are slightly curved. These lateral edges are interconnected by an upper edge 8 of curvilinear shape, which has its concavity facing outwardly of the panel and upwardly of the erected shelter shown in FIG. 1. In the illustrated embodiment, this upper edge 8 forms two curves, 9 and 11, 11 and 13 or 13 and 9, which are symmetrical relative to the median plane of the panel and are interconnected at a center apex 10.

The panels 1, 2 and 3 are united in pairs along their upper edge 8 by seams of stitching, or if desired welds or the like, 9, 10 and 13, and the three apices 10 form the center point of the shelter.

Disposed at the end of each of the seams 9, 11 and 13 located at the opposite end to the center apex 10, is a means, such as an eyelet or the like, for receiving the end of a support post, relatively 15, 16 and 17. Further, tension cables 18 and 19 extend from each of the ends of the lower edge 4 of the panels, and at least one cable 21 maintains the post in position.

With this arrangement, the fabric formed by the three panels 1, 2 and 3 can be placed on the posts 15, 16 and 17 and then put under tension by means of the cables 18 and 19 so as to constitute a protective roof or shelter. In the case of a shelter having three panels, as shown in FIG. 1, the whole of the fabric thus protects a portion of the ground of substantially hexagonal shape defined by the points of the fixing of the cables 18 and 19 to the lower edge of the panels. This lower edge 4 is shorter than the distance between the points 22 and 24 of the outer ends of the corresponding seams 9 and 11, i.e. in fact the adjacent posts 15 and 16, and these posts are located outside the panels and thus slightly outside the hexagonal area which is completely free for the user. Further, the tensioning action of the cables 18 and 19 in combination with the special shape of the junction lines 9, 11 and 13 between the panels and with the suspension of the fabric at exterior end points, ensures that the whole of the fabric has an even tension which is sufficient to reduce the differences in height between the various points to a minimum. Consequently, at practically all the points of the roofing, the tangent of the greatest slope has an inclination which allows the flow of rain water. Only the center zone, or the zone in which all the panels are united in the case of a shelter having at least three panels, does not satisfy this condition. For example, in the embodiment shown in FIG. 1, a relatively small zone around the center apex 10, tends to approach the horizontal position so that this is liable to be an obstacle to the correct flow of rain water.

Consequently, the center apex 10 is preferably lifted up by cables or straps which are made taut therebetween and each of the end points 22, 24 and 25 of the seams 9, 11 and 13.

Figure 3:
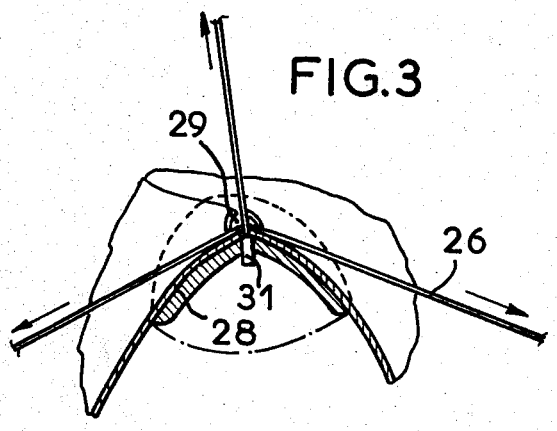
FIG. 3 is a detail view, to an enlarged scale, of a manner for fixing cables maintaining the centre of the shelter of FIG. 1.

As shown in FIG. 1, cables 26 may be hung from outside the tent and attached to the center apex 10 by means of a fabric loop or like means (not shown). Preferably, these cables are fixed to a dome 28 on which the fabric is applied, an aperture 29 in the latter allowing the fixing. For example, as shown in FIG. 3, the cables 26 extend not only through the aperture 29, but also the dome 28 and are held fast below the latter at 31 by a knot, weld or like means, or, according to a modification (not shown), the dome comprises a center boss which projects through the aperture 29 of the fabric and on which the cables are secured so that they are prevented from escaping and can be put under tension. The center apex 10 in this way reaches a height slightly below that of the top of the posts 15, 16 and 17, so that this still further clears the space below the shelter and imparts to the fabric the desired slope and tension.

Figure 2:
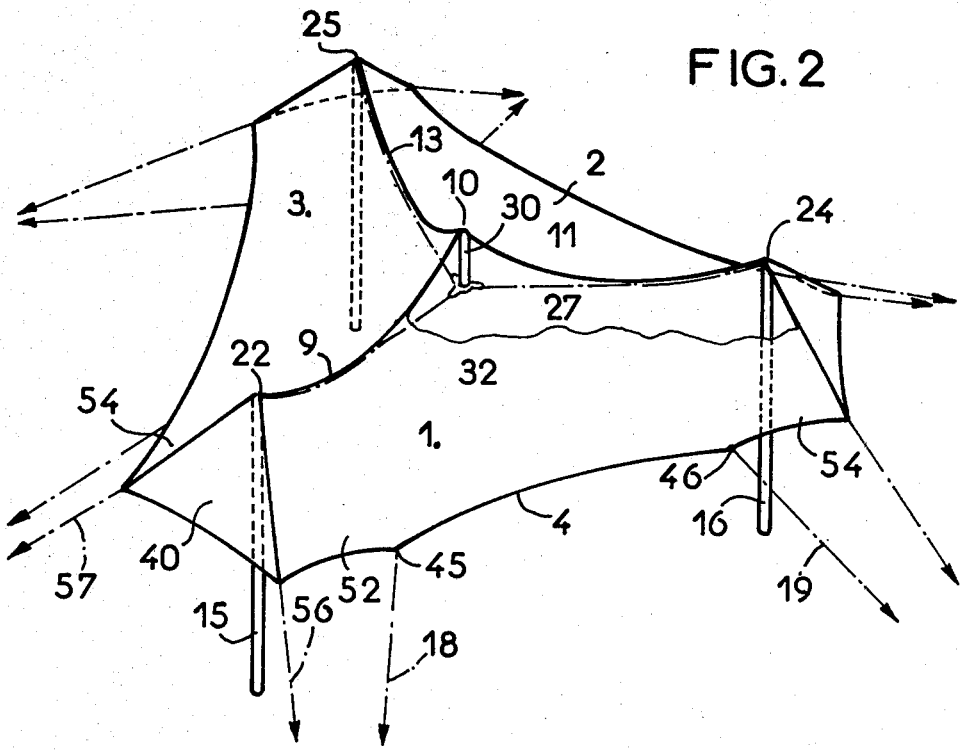
FIG. 2 is a view similar to FIG. 1 of a modification.
Figure 4:
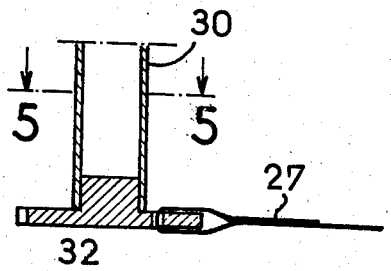
FIG. 4 is a detail view, to an enlarged scale, of a device for maintaining the center of the shelter of FIG. 2, this view being in vertical section taken on line 4—4 of FIG. 5.
Figure 5:
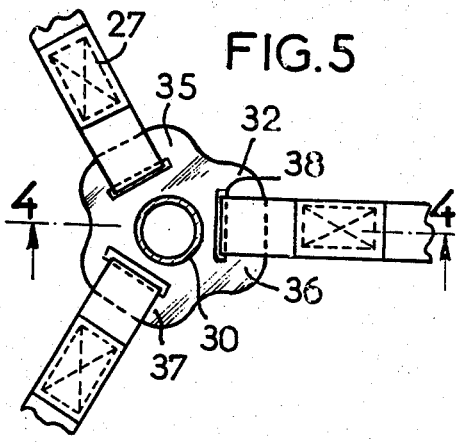
FIG. 5 is a plan view of the device of FIG. 4.

In a modification shown in FIGS. 2, 4 and 5, cables or straps 27 are hung inside the shelter. The center point 10 is then supported by a small vertical post 30 which bears on a plate 32 with which latter it is rigid in the center part thereof by means of a centering member 34 which is formed in the illustrated embodiment by a pin on which fits the post 30 which is hollow (FIGS. 4 and 5). The plate 32 has preferably three arms, respectively 35, 36 and 37, each of which is provided with an aperture or slot 38 in which the cable or strap 27 is held.

Figure 6:
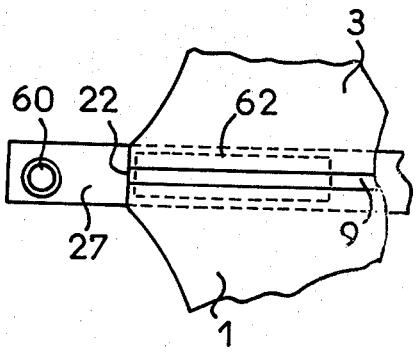
FIG. 6 is a plan view, to an enlarged scale, of one outer end of the shelter of FIG. 1 at the point at which it is hooked to the post.

At their opposite end, the cables or straps 27 or 26 are hooked to the top of the posts 15, 16 and 17 respectively, by means of eyelets or the like which are independent from or rigid with those of the fabric. Preferably, however, when the apex 10 is raised by means of straps, the eyelets are carried solely by these straps, as shown in FIG. 6. The straps 27 then have a length exceeding that required for the tension and an eyelet 60 is fixed to the end of each of them. The two adjacent fabric panels 1 and 3 assembled by the stitching 9 are fixed at the same time to the strap, for example by stitching 62, a weld or any other means in the region of the end of the junction line 9 but at a distance from the end of the strap, so that only the eyelet 60 reaches the top of the post 15 (FIG. 1). The straps 26 and 27 are thus put under the desired tension once and for all and remain adjusted even when the fabric is folded up. The post 30 may even be released from the plate 32, while the cables remain taut, which facilitates the erection of the shelter.

It will be understood that the plate 32 may have any suitable shape. Likewise, the post 30 may be supported in any suitable manner and the cables or straps may be hooked, welded, adhered or attached in some other way according to needs.

Whatever be the embodiment, the cables, straps or the like are put under such tension that they support the post 30 in a regular and even manner, maintain the apex 10 in its raised position and relieve the fabric along the seams 9 and 11 over a great distance.

When it is desired to still further increase the area protected by the shelter, it is advantageous to extend the panels 1, 2 and 3 in the manner shown in FIG. 2, i.e. to extend the lower edge 4 beyond the fixing points of the cables 18 and 19 and of the corresponding posts 15, 16 and 17, by a triangular portion 52, 54, which is preferably in one piece therewith. A triangular-shaped fabric 40 then unites the two adjacent panels and forms with the extensions 52 and 54 a complementary porch or turret.

The cables 21 maintaining the posts in position are then replaced by cables 56 and 57 fixed to the two ends of the base of the triangular portion 40, but the tensioning means remain unchanged and the cables 18 and 19 are fixed at two points 45 and 46 respectively, remote from the lateral sides of the panel and spaced apart a distance corresponding to the length of the unextended lower edge 4.

Figure 7:
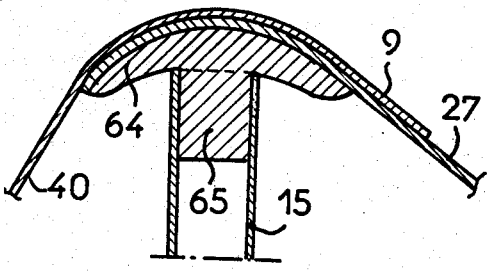
FIG. 7 is a vertical sectional view, taken on line 7—7 of FIG. 8 and to an enlarged scale, of the top of a support post of the shelter of FIG. 2.
Figure 8:
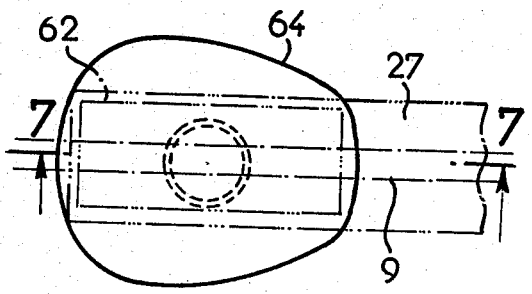
FIG. 8 is a plan view of the post of FIG. 7.

The center apex 10 is also raised, either by exterior cables or by interior cables. However, the eyelets for hooking to the support posts 15, 16 and 17 may be eliminated in a modification. Each of the posts then has (FIGS. 7 and 8) an enlarged curved convex head 64, which is for example moulded from plastics material and fitted by means of a lower center spigot 65 in the post 15. The curved upper surface widens outwardly of the shelter and has such curvatures that it is adapted to the apex of the trihedron formed by the panels and the triangular portion 40. The fabric is merely placed on this head, but it is however solidly held in position and may transmit to the post the action of the cables 56 and 57.

Figure 9:
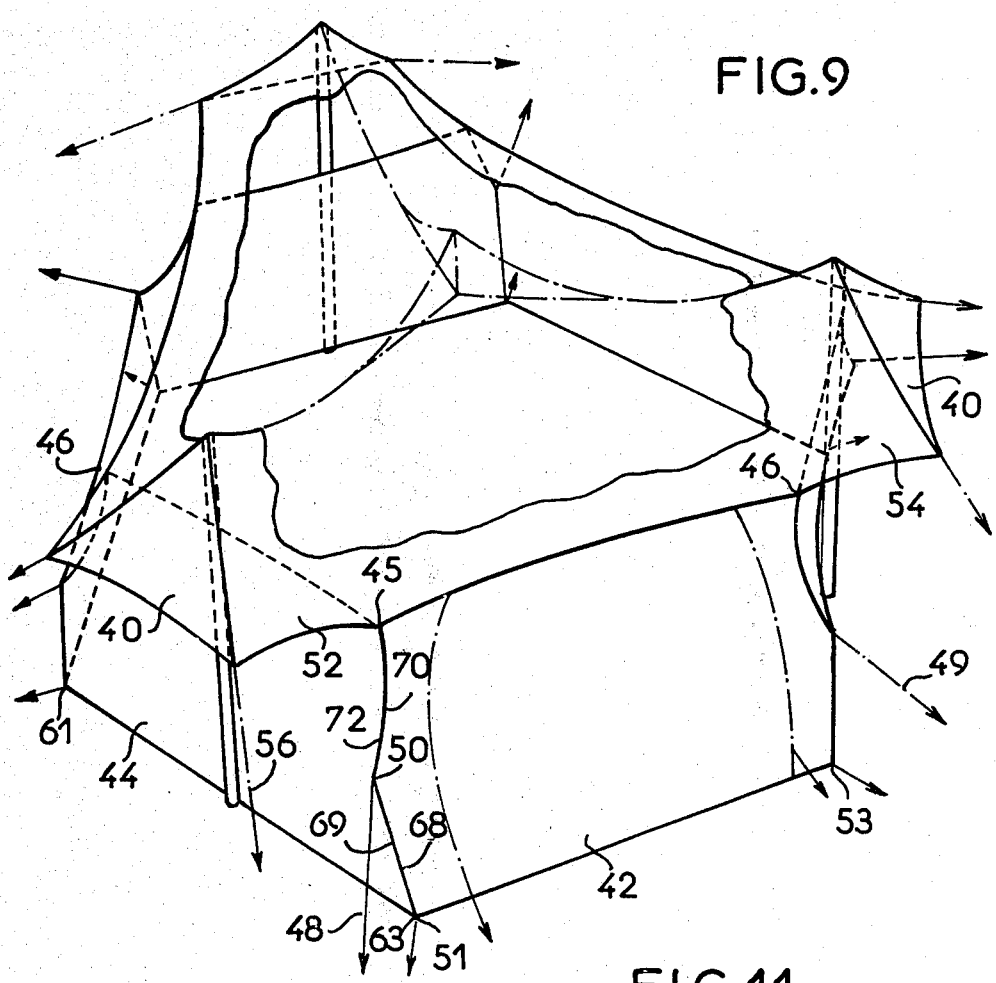
FIG. 9 is a perspective view of a shelter according to the invention which forms a complete tent.

The shelter may also be completed by lateral walls so as to form a completely closed tent (FIG. 9). The roofing of this tent may be formed by the shelter shown in FIG. 1 or be provided with one or more porches such as those of the shelter shown in FIG. 2. In any case, the lateral walls 42 downwardly extend each of the panels 1, 2 and 3 between the points 45 and 46 at which the tensioning means are fixed, whereas walls 44 interconnect these walls 42 between the points 46 and 45 of two different roofing panels. Tensioning cables 48 and 49 are attached to each of the junction lines between these walls at a point intermediate between the lower edge of the roof panel and the ground as shown at 50 in FIG. 9.

Figure 10:
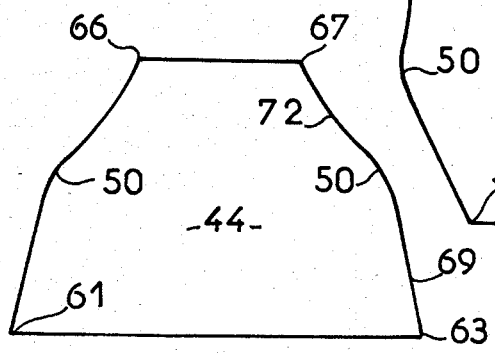
FIGS. 10 and 11 are plan views of lateral panels of the tent of FIG. 9.
Figure 11:
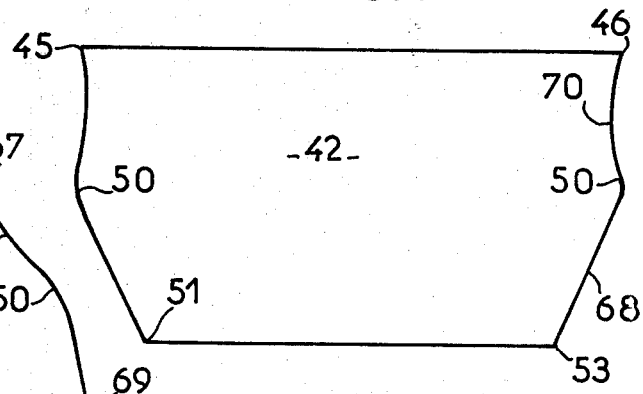

As shown more particularly in FIGS. 10 and 11, each wall 42 or 44 has the general shape of a trapezium, but these trapeziums are inverted. Thus, the small base 51, 53 of a wall 42 is equal to the large base 61, 63 of a wall 44 and is located, like the latter, in the lower part of the tent, which thus has the shape of a regular hexagon. On the other hand, the upper part of the wall 42 is formed by its large base 45, 46 and the upper part of the wall 44 is formed by its small base 66, 67.

The trapeziums 42 and 44 are isosceles but their lateral sides each have successively a rectilinear part 68, 69 and a curved part 70, 72. The rectilinear parts 68, 69 of all the walls have the same length and the curved parts have the same radius of curvature, so that the confronting sides of the adjacent walls 42 and 44 have, when flat, angularly offset isometric profiles.

The tensioning cables 48 and 49 are fixed at 50 at the point of transition between the rectilinear parts 68, 69 and the curved parts 70, 72 which corresponds to the maximum width of the wall 42. It is then found that the entire fabric is regularly taut. The force exerted by the cables 48 and 49 is indeed transmitted to the two adjacent walls and to the corresponding roofing panel through the wall 42.

The wall 44 may be if desired upwardly extended to the roof, but it is preferably limited to the small base 66, 67 and defines an opening, which is, for example, protected by a porch 40.

It must be understood that the tent may have a second inner or outer cover of conventional type or constructed in accordance with the invention. When the two covers are of the type of the tent shown in FIG. 9, means to enable them to be held fast with each other in a permanent manner or temporarily are preferably mounted thereon at different points and mainly at the points 50 for fixing the tensioning cables, so that they may be put under tension simultaneously with the same cables, either of these covers may moreover be made fast with a ground sheet or carpet.

A shelter or tent of this type may have a variable number of sides. The number of roof panels may be more than three, or may even possibly be limited to two. In any case, the area of the ground protected by this shelter has the shape of a polygon whose sides are in a number which is double the number of roof panels and the space thus protected is completely free for the user.

Indeed, the posts, a small number of which are employed, are always located at the periphery, and the centre of the roof, even when it is raised by cables and the short post 30, leaves a great height free. On the other hand, owing in particular to the regular tension of the whole of the fabric resulting from, among other factors, the special shape of the roof panels and possibly of the walls and to the application of the tensions at points which are closer together than the posts, the amount of fabric required for constructing the shelter is much less than that usually employed for protecting a similar space. Consequently, the amount and weight of material to be transported and handled when erecting and taking down are reduced.

Having now described my invention what I claim as new and desire to secure by Letters Patent is:

1. A fabric shelter which is capable of being taken down, such as a roof, tent, or the like, said shelter comprising at least three assembled fabric roof panels which panels have in their upper part a seam line between adjoining roof panels along a curvilinear upper edge of each roof panel, which curvilinear edge is concave and relates to an upwardly-facing concave curvilinear seam line between adjoining roof panels, support posts adjacent outer ends of said edges and in supporting relation to the roof panels, and means for tensioning each of said roof panels, said means being fixed to a substantially rectiliner edge of the corresponding roof panel opposed to the seam line at two points which are spaced apart a distance which is less than a distance between said support posts in supporting relation to the corresponding panel.

2. A shelter as claimed in claim 1, wherein the curvilinear upper edge and the opposite edge of each panel are interconnected by small curved side edges.

3. A shelter as claimed in claim 1, wherein at least two adjoining roof panels are extended beyond the tensioning means to beyond the corresponding support post and a substantially triangular portion of fabric interconnects said at least two adjoining roof panels and constitutes a porch outside the corresponding support post.

4. A shelter as claimed in claim 1, 2 or 3, wherein the tensioning means are cables extending from the fabric.

5. A shelter as claimed in claim 1, comprising lateral walls which extend the roof panels between the fixing points of said tensioning means of a given panel, and other lateral walls interconnecting the first-mentioned lateral walls.

6. A shelter as claimed in claim 2, comprising lateral walls which extend the roof panels between the fixing points of said tensioning means of a given panel, and other lateral walls interconnecting the first-mentioned lateral walls.

7. A shelter as claimed in claim 3, comprising lateral walls which extend the roof panels between the fixing points of said tensioning means of a given panel, and other lateral walls interconnecting the first-mentioned lateral walls.

8. A shelter as claimed in claim 5, 6 or 7, comprising tensioning cables fixed to a junction between two adjacent lateral walls at a point intermediate between the roof panels and a ground on which the shelter is erected.

9. A shelter as claimed in claim 1, wherein each roof panel has a pair of said curvilinear upper edges relating to said seam lines connecting the two adjoining roof panels, all the pairs of upper edges of the roof panels being united at a centre apex.

10. A shelter as claimed in claim 9, comprising exterior means for holding the center apex in a raised position, which exterior means are under tension between said apex and the outer end point of each of the seam lines of the upper edges of the roof panels.

11. A shelter as claimed in claim 9, comprising inner means for holding the center apex in a raised position, which inner means are under tension between each of the outer end points of the upper edges of the roof panels and a plate carrying a vertical support post for the center apex.

12. A shelter as claimed in claim 5, 6 or 7, wherein the lateral walls all have a generally trapezoidal shape, the small base of the trapezoidal lateral walls extending the roof panels being substantially equal to the large base of said other lateral walls and being, like the large base, placed in the lower part of the shelter.

13. A shelter as claimed in claim 12, wherein the lateral sides of the lateral walls have in succession a rectilinear part and a curved part and are formed by isometric profiles in the flat state.

14. A shelter as claimed in claim 10 or 11, wherein the means for holding the center apex in a raised position are straps which are fixed to the fabric in the vicinity of said outer ends of said edges of the roof panels, extended beyond said roof panels and provided with an eyelet in hooking relation to the corresponding support post.

15. A shelter as claimed in claim 3, wherein said porch has an apex portion and said corresponding post has an enlarged curved convex head which fits in said apex portion of the porch.

16. A fabric shelter which is capable of being taken down, such as a roof, tent, or the like, said shelter comprising a plurality of assembled fabric roof panels which panels have in their upper part a seam line between adjoining roof panels along a curvilinear upper edge of each roof panel, which curvilinear edge is concave and relates to an upwardly facing concave curvilinear seam line between adjoining roof panels, support posts adjacent outer ends of said edges and in supporting relation to the roof panels, and means for tensioning each of said roof panels, said means being fixed to a substantially rectilinear edge of the corresponding roof panel opposed to the seam line at two points which are spaced apart a distance which is less than a distance between said support posts in supporting relation to the corresponding panel.

* * * * *